US005829417A

United States Patent [19]

Nyffenegger

[11] Patent Number: 5,829,417

[45] Date of Patent: Nov. 3, 1998

[54] PROCESS FOR IMPROVING FUEL SPRAYING IN INTERNAL COMBUSTION ENGINES

[76] Inventor: Hans Nyffenegger, Im Zentrum 10, CH-8604 Volketswil, Switzerland, CH-8604

[21] Appl. No.: 765,184

[22] PCT Filed: Jun. 30, 1995

[86] PCT No.: PCT/CH95/00148

§ 371 Date: Feb. 5, 1997

§ 102(e) Date: Feb. 5, 1997

[87] PCT Pub. No.: WO96/01366

PCT Pub. Date: Jan. 18, 1996

[30] Foreign Application Priority Data

Jul. 4, 1994 [CH] Switzerland ..... 2129/94

[51] Int. Cl.[6] ..... F02M 17/22; F02M 29/04

[52] U.S. Cl. ..... 123/522; 123/590

[58] Field of Search ..... 123/522, 590, 123/591

[56] References Cited

U.S. PATENT DOCUMENTS

| | | | |
|---|---|---|---|
| 3,404,667 | 10/1968 | Mennesson | 123/119 |
| 4,376,423 | 3/1983 | Knapstein | 123/1 |
| 4,426,984 | 1/1984 | Gilbert | 123/522 |
| 4,524,748 | 6/1985 | Giannotti | 123/591 |
| 5,054,453 | 10/1991 | Onufer | 123/522 |
| 5,427,077 | 6/1995 | Gilbert | 123/522 |
| 5,522,368 | 6/1996 | Tusino | 123/522 |
| 5,655,505 | 8/1997 | Tusino | 123/522 |

FOREIGN PATENT DOCUMENTS

| | | |
|---|---|---|
| 2501793 | 9/1982 | France . |
| 2639920 | 3/1978 | Germany . |
| 2900459 | 7/1980 | Germany . |
| 57-135251 | 8/1982 | Japan . |
| WO 9213188 | 8/1992 | WIPO . |

*Primary Examiner*—Erick R. Solis

*Attorney, Agent, or Firm*—Weingarten, Schurgin, Gagnebin & Hayes LLP

[57] ABSTRACT

It is known that enriching fuel with oxygen improves combustion and thus reduces fuel consumption, improves performance and reduces pollutant and soot particle emission. In order to prevent the air admixed into the fuel before the air is introduced into the combustion chamber from forming air bubbles in the supply pipe, the fuel-air mixture is selectively degassed depending on the size of the air bubbles. The fuel is fed by a feed pump (4), through a suction pipe (2), from a tank (1) into an apparatus (3), and from there into an internal combustion engine (5). Air is admixed by device (6). The apparatus (3) contains a degassing chamber (7) with a floater (8) that closes the lower admission (10) with a sealing cone (9) and that controls with an actuating pin (11) an inlet valve (12) depending on the level of fuel in the chamber.

17 Claims, 3 Drawing Sheets

PROCESS FOR IMPROVING FUEL SPRAYING IN INTERNAL COMBUSTION ENGINES

BRIEF SUMMARY OF THE INVENTION

The present invention concerns a method for the admixture of air into fuel in an internal-combustion engine, before introduction into the combustion chamber, by which an improvement in fuel atomization is to be obtained.

BACKGROUND OF THE INVENTION

It has long been known that both the performance as well as the optimal combustion values of an internal-combustion machine, especially of an internal-combustion engine, are greatly dependent upon the mixture of fuel and air. Usually the mixture of fuel and air first takes place in the combustion chamber of the internal-combustion engine. But the concept of mixing air into the fuel even before the fuel reaches the combustion chamber is also known. For example, DE-A 2,639,920 discloses a fuel injector based upon a principle similar to that of a carburetor. According to JP-A 57/135, 251, air is combined with the fuel in the fuel line, and the fuel/air mixture is produced in a mixer, arranged between the fuel pump and an injection pump, and subjected to high pressure, the mixture being sprayed into the combustion chamber at a pressure of about 200 atm. Whereas the admixture of fuel takes place under high pressure in the case of the last solution cited, FR-A 2,501,793 discloses a solution in which a regulator is arranged in the fuel line, which mixes fuel and air. This principle was published in an improved version in WO 92/13188.

This procedure, operating essentially on the venturi principle, has effected fuel savings and a performance increase, a reduction in pollutants and soot particles, both in passenger cars with gasoline engines and in diesel trucks. These advantages are exhibited essentially by all processes which result in an especially homogeneous fuel-air mixture. The more homogeneous the air distribution in the fuel, the better the combustion. If it is ensured that a very high number of extremely small air bubbles are dissolved in the fuel, the fuel reaching the combustion chambers through the injection nozzles will be atomized so finely that virtually no droplet formation will still be possible.

Although this approach exhibits extremely positive values relative to work, the process failed to prevail in practice. This process, namely, proved to be unreliable in practice. More precise studies showed that relatively large bubbles continually occurred in the system, which led to disturbances. The essential operating parameters for the achievement of the most homogeneous mixture possible of air and fuel, could not be stably set. In addition to the known operating parameters, namely, the viscosity, the temperature and the pressure; it proved to be the case in particular that the course of the fuel lines likewise had a significant influence upon bubble size.

It is consequently the task of the present invention to improve a process for the admixture of air into fuel in an internal-combustion engine prior to entry into the combustion chamber in such a way that the arising difficulties can be avoided and the most homogeneous fuel-air mixture possible produced.

This objective is achieved with a process of the initially cited type by the fact that a selective degassing of the air-fuel mixture takes place after the admixture of air and before the partially degassed mixture is sent to the combustion chamber. It was found that there must be assurance that unmixing takes place during the conveyance of the fuel-air mixture, which leads to the formation of relatively large bubbles. This danger is for example reduced by the fact that only the smallest air bubbles reach the line leading to the combustion chamber. It consequently makes sense for the selective degassing to take place on the basis of air-bubble size. The relevant simplest solution is one in which the selective degassing is achieved by passing the fuel-air mixture into a chamber where the mixture is held back for a minimal period of time under the action of gravity and relatively large bubbles rise to the top, the mixture being thereby degassed in part, while small bubbles remain in the mixture. This is determined essentially by the time the mixture is retained in the chamber. The retention time is dependent, on the one hand, by the flow of fuel and, on the other, upon the size of the chamber. The retention time is optimally selected in such a way that ultimately only those bubbles still remain which are in the micrometer-sized range. It is interesting that the mixture, selectively degassed in this way, will advantageously contain less than one percent by volume of air. In the extreme case, values were measured, where the air constituted less than one tenth of one percent by volume. Despite this enormously small quantity of air, the number of bubbles in the selectively degassed mixture is very high. Advantageously, this can be more than one thousand bubbles per cubic millimeter. Such a selectively degassed mixture has the enormous advantage that it leads to astonishingly stable conditions of operation, the results of measurement being also completely independent of the arrangement of the fuel lines. This permits the admixture of air as well as the selective degassing to be arranged both upstream as well as downstream of the fuel pump.

The admixture of air, as is known, can be effected most easily by means of a venturi tube. To avoid the need to vent already degassed fuel into the atmosphere, or the need to vent degassed air from the chamber where the degassing takes place, it is expedient to extract the air for air admixture always directly or indirectly from the zone of the chamber. Further advantageous process-technical features issue from the dependent subclaims, their significance being explained in the following description.

BRIEF DESCRIPTION OF THE SEVERAL VIEWS OF THE DRAWING

Appearing in:

FIG. 1 is a schematic drawing of a device for implementation of the process, where the suction line is arranged between fuel pump and fuel tank and the admixture of air is based on the venturi tube, while

FIG. 5 shows a lengthwise section through the center of a device for implementation of the process per the schematic drawing in FIG. 3, whereas

DETAILED DESCRIPTION OF THE INVENTION

Figure 1:
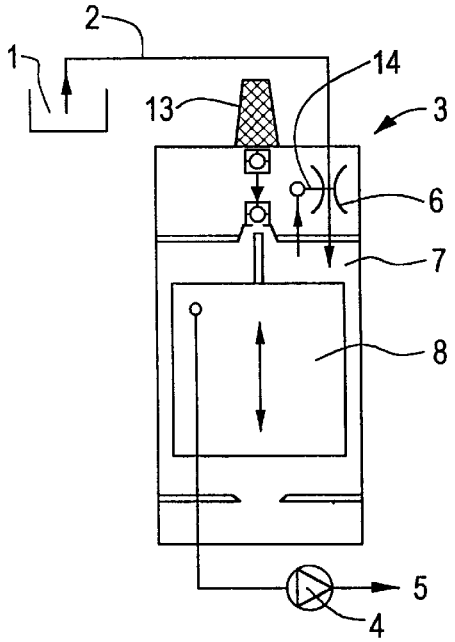

The various possibilities for realization of the invented process can best be seen from the four schematically represented variants according to FIGS. 1 through 4. The fuel from the tank 1, per the version in FIG. 1, is sent directly over the suction line 2 into the device, labeled as a whole with numeral 3, and from there to the engine 5 by means of a fuel pump 4. In the variants per FIGS. 1 through 3, the air-admixing unit 6 in arranged within the device 3 itself. From there, the mixture is sent as fuel and air into a chamber 7 which is designated as the degassing chamber. Present in the degassing chamber 7 is a float 8 which is equipped with appropriate means, according to the fuel level in the chamber, either to close lower outlet 10 to the chamber 7 with a lower sealing cone 9 or to act upon an inlet valve 12 by means of a triggering pin 10, permitting fresh air to flow from the atmosphere directly into the chamber 7 through an externally arranged filter 13. In the variant according to FIG. 1, the device 6 for the admixture of air operates according to the venturi-tube principle. The air aspirated from the flow is sucked out of the degassing chamber 7, in this case directly through the line 14. Here, as in the case of all variants, degassing takes place by virtue of the fact that the fuel-air mixture rests for a time in chamber 7 and the air bubbles present there rise. The bigger the air bubbles, the more quickly they rise. Because the rate of flow in chamber 7 is extremely low, it is not possible for air bubbles still exhibiting a resulting buoyancy relative to the viscosity of the fuel to be carried along with the flow. In the normal case, the air bubbles remaining in the fuel are those in the micromillimeter range. If the admixture of air takes place in an optimal manner, it has been determined that an air-fuel emulsion is produced with over a million bubbles per cubic millimeter; this means that a molecularly dispersed system of fuel and air forms. This dispersion remains in existence as such for several minutes, so that only relatively large air bubbles rise, without the molecularly dispersed system separating again into gas and liquid. The selective partial degassing thus serves merely for the separation of the air inclusions still concretely present as air bubbles. It was found with this arrangement that an absolutely reliable operation of the engine results even with the most diverse and changing parameters. The benefits of the admixture of air into the fuel thus consequently result, without the need to deal with the problems this formerly caused.

In the example presented here, air is aspirated directly from the degassing chamber 7. If chamber 7 is however largely filled with the fuel-air mixture, the float 8 will then be in the upper position and the triggering pin 11 will open the shutoff valve 12, thus establishing the connection with an externally mounted air filter 13. If the fuel pump then withdraws a part of the fuel-air mixture, air will flow through the filter 13 into the chamber 7, the float 8 will then sink again, air being then increasingly extracted from the tank 1 through the suction line 2. The lower seal, formed by elements 9 and 10 in Figure 3 and 4, serves to ensure that the fuel pump 4 will be able to empty the degassing chamber 7 to an overly great extent.

Figure 2:
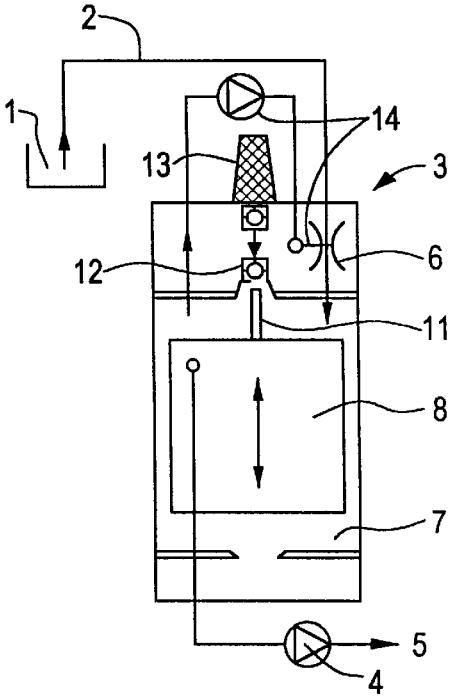
FIG. 2 shows the same arrangement, but with the admixture of air being effected by means of an air pump.
Figure 5:
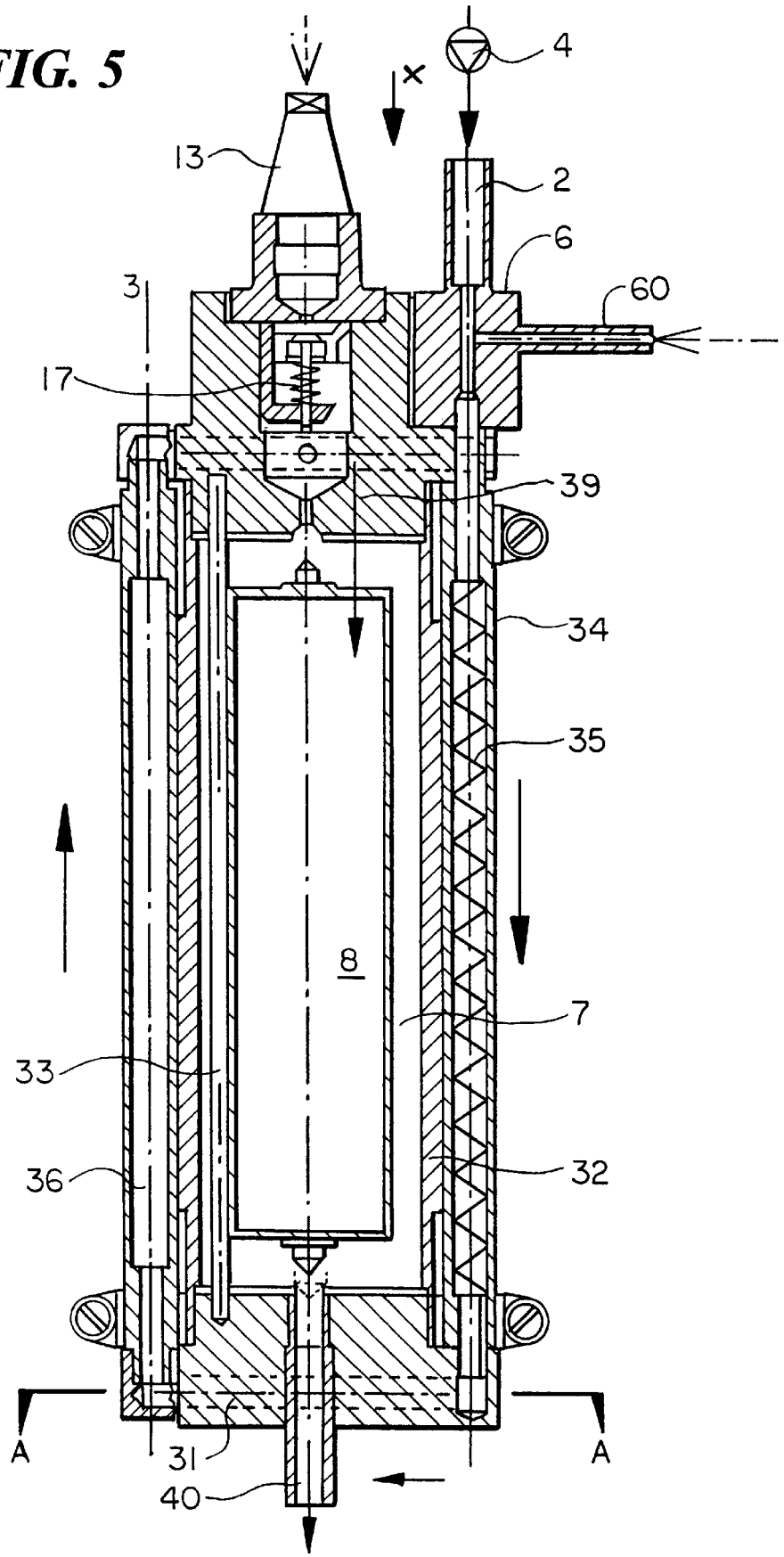
Figure 6:
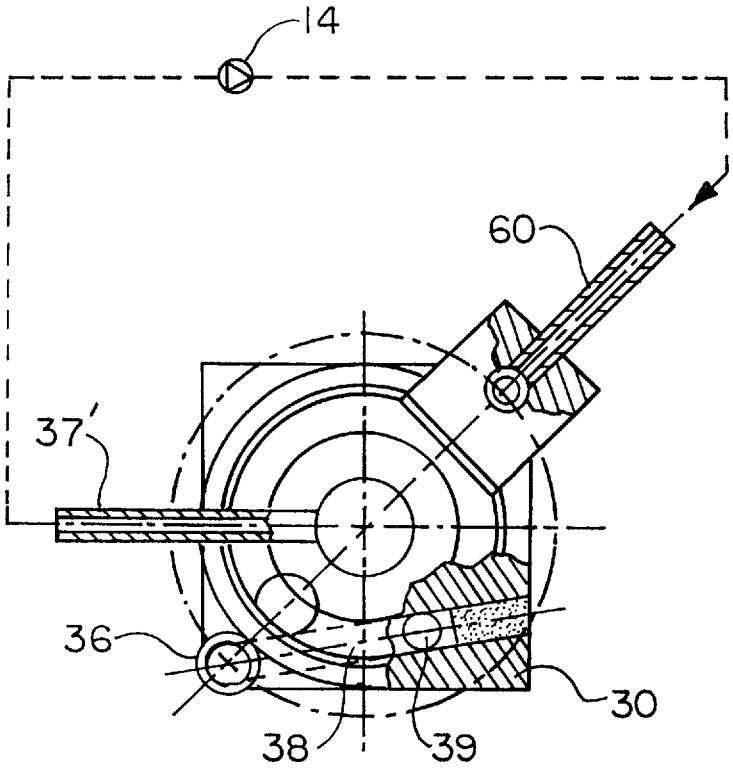
FIG. 6 is a view from the top.
Figure 7:
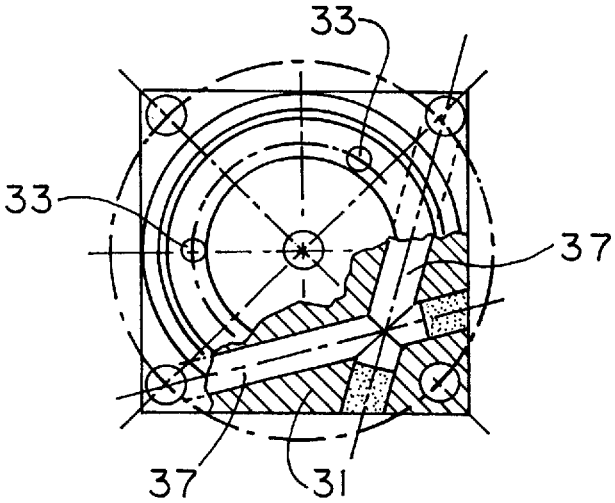
FIG. 7 shows a partial section along line A—A in FIG. 6.

While the air intake in the variant per FIG. 1 is based solely on the suction effect of the venturi tube of the air-admixing unit 6, an active air pump 14 is provided for this purpose in the variant according to FIG. 2. This permits active control of the gas intake from chamber 7 and the admixture, at a desired pressure, of the gas thus extracted with the fuel flowing in over the suction line 2. It is advantageous in that case to provide a specially designed mixing zone between the air-admixing unit 6 and the degassing chamber 7. This will be evident from the device per FIGS. 5 through 7 which is yet to be described below.

Figure 3:
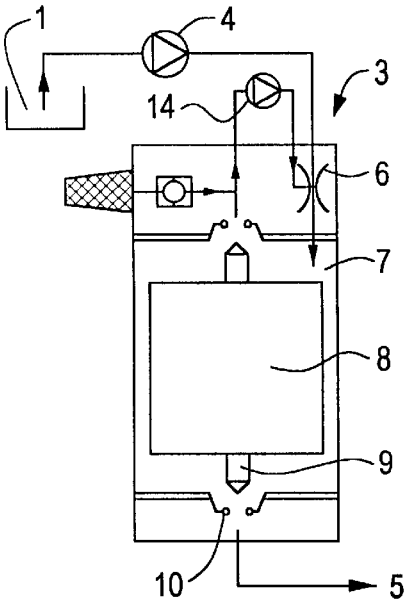
FIG. 3 shows the variant according to FIG. 2, but with the fuel pump positioned upstream of the unit for the admixture of air.
Figure 4:
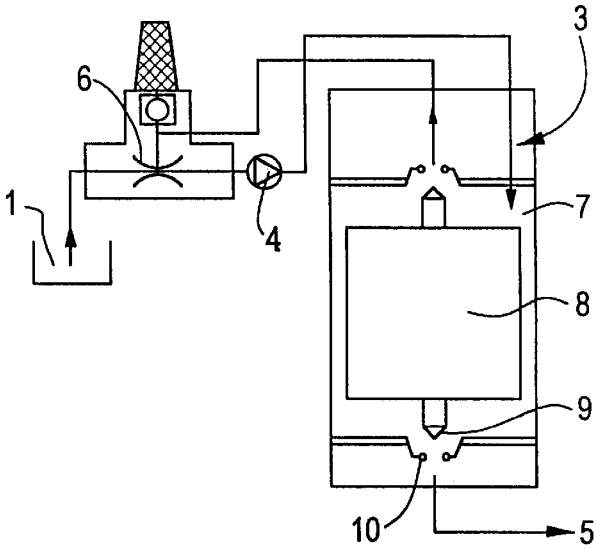
FIG. 4 shows a variant in which the admixture of air lies upstream of the fuel pump and degassing chamber is located separate from it downstream.

In the variant according to FIG. 3, the unit 3 operating according to the invention is again of course positioned downstream of the tank 1, but no longer upstream of the fuel pump 4, being rather downstream from it. Exactly as in the case of the execution variant per FIG. 2, a separate air pump 14 is also provided. Both air as well as fuel are consequently mixed together under pressure in the air-admixing unit 6. It is also again advantageous in this case to provide a mixing zone downstream of the air-admixer 6. Finally, in the variant per FIG. 4, the air-admixing unit 6 is arranged separately from the device 3. The fuel pump 4 is then arranged between the air-admixing unit 6 and the degassing chamber 7. The admixture of air will then take place once more by means of the venturi principle. The method of operation of the degassing chamber 7 with the float 8 corresponds absolutely to the execution variants described above. The concrete realization of the process corresponding to variant shown in FIG. 3 appears in FIGS. 5 through 7. The device 3 consists of a cover plate 30 and a base plate lying opposite to it. Both plates 30, 31 are kept apart from each other by the cylindrical wall 32. The cylindrical wall 32 encloses the interior degassing chamber 7 containing the float 8. The guide rods 33, anchored both in the cover plate 31 as well as the base plate 30, form a sort of cage for the float. The float is positioned in such a way that it will always travel precisely in an axial direction alone the central axis. This ensures that, in the lowermost or uppermost position of the float 8, the sealing tips of the latter will respectively seal the air opening in the cover plate or the mixture inlet port in the base plate 31. The fuel is fed here by means of the fuel pump 4, through line 2, to the air admixer which is arranged on the head plate 30. Taking place there is the admixture of air which is sent over the air-line 60 by the air pump 4. The fuel-air mixture thus arrives in a mixing segment 34, consisting in principle of a tube with a built-in baffle plate 35 which results in a thorough mixture of fuel and air. From the mixing segment 34, the mixture is sent through two interconnected bores in the base plate 31 to a feed line 36 which already acts as a first unmixing zone. Through the feed line 36, leading from the base plate 31 to the cover plate 30, the fuel-air mixture is sent, finally, through the feed bore 38 in the head plate to a vertical inlet bore 39, through which the mixture finally reaches the chamber 7. The partial, selective degassing takes place in the chamber 7 in the manner described above. This partially degassed mixture is sent to the engine through line 40. The check valve 17, present in this execution variant of the device 3, is opened only by reduced pressure, which occurs when the float 8 is in the uppermost position and closes the central air-inlet port. Fresh air is then sucked in through the air filter 13 via line 37, valve 17 being opened.

The form of the construction of the device 1 is of no importance. The principle of the invention is bases solely upon the principal concept that, if possible, only a homogeneous dispersion of fuel and air should be employed and the feeding of relatively large air bubbles into the combustion chamber avoided. This achieved according to the process by partial, selective degassing.

I claim:

1. Process for the admixture of air into fuel of an internal-combustion engine before introduction into the combustion chamber, a partial degassing being effected following admixture, in which case excess fuel bubbles are separated from the air-enriched fuel, characterized by the fact that the introduction of air in the fuel is effected in a venturi tube as a device for air admixture (6), after which the fuel-air mixture is sent into a mixing zone (34) with built-in baffle plate (35), the separation of the excess fuel bubbles taking place in a chamber (7), in which the fuel-air mixture is retained for a minimal period of time adequate to permit the largest bubbles to exit the fuel-air mixture, thus selectively degassing the fuel-air mixture as a function of bubble size.

2. Process according to claim 1, characterized by the fact that both the admixture of air as well as selective degassing takes place in the zone of the suction line between fuel tank and fuel pump.

3. Process according to claim 1, characterized by the fact that both the admixture of air as well as selective degassing take place in the zone of the pressure line between fuel pump and combustion engine.

4. Process according to claim 1, characterized by the fact that the mixture is degassed until the maximal size of the remaining gas bubbles is in the micrometer range.

5. Process according to claim 1, characterized by the fact that the aspiration of air always takes place, directly or indirectly, from the zone of the chamber in which degassing takes place.

6. Process according to claim 1, characterized by the fact that the input of fresh air for admixture takes place as a function of the filling level of the fuel-air mixture in the degassing chamber.

7. Process according to claim 5, characterized by the fact that a discharge port for the fuel-air mixture for the exit of the fuel-air mixture from the degassing chamber is regulated as a function of the prevailing filling level.

8. Process according to claim 5, characterized by the fact that the average retention time of the fuel-air mixture in the degassing chamber amounts to at least 30 seconds.

9. Process according to claim 7, characterized by the fact that the admixture of air takes place by means of a venturi tube.

10. Process according to claim 3, characterized by the fact that the aspiration of air is effected, directly or indirectly, from the zone of the chamber in which degassing takes place.

11. Process according to claim 10, characterized by the fact that the aspiration of air from the outside takes place through an air filter.

12. Process according to claim 10, characterized by the fact that the aspiration of air for admixture takes place as a function of the filling level of the fuel-air mixture in the degassing chamber.

13. Process according to claim 10, characterized by the fact that the outlet port for the fuel-air mixture for the discharge of the fuel-air mixture from the degassing chamber is controlled according to the prevailing filling level.

14. Process according to claim 10, characterized by the fact that the admixture of air into the fuel takes place actively by means of a pump.

15. Process according to claim 10, characterized by the fact that the average time the fuel-air mixture is retained in the degassing chamber amounts to at least 30 seconds.

16. Process according to claim 1, characterized by the fact that the fuel-air mixture is passed through an active or passive mixing zone after the admixture of air into the fuel, but before selective degassing.

17. Process according to claim 8, characterized by the fact that the admixture of air takes place by means of a venturi tube.

* * * * *